US008764003B2

(12) United States Patent
Oyama et al.

(10) Patent No.: US 8,764,003 B2
(45) Date of Patent: Jul. 1, 2014

(54) CONTROL METHOD OF FEEDER AND IMAGE FORMING SYSTEM

(71) Applicants: Hiroshi Oyama, Tokyo (JP); Kenji Izumiya, Tokyo (JP); Kiyoto Kojima, Tokyo (JP); Atsushi Takahashi, Tokyo (JP)

(72) Inventors: Hiroshi Oyama, Tokyo (JP); Kenji Izumiya, Tokyo (JP); Kiyoto Kojima, Tokyo (JP); Atsushi Takahashi, Tokyo (JP)

(73) Assignee: Konica Minolta Business Technologies, Icn., Tokyo (JP)

( * ) Notice: Subject to any disclaimer, the term of this patent is extended or adjusted under 35 U.S.C. 154(b) by 0 days.

(21) Appl. No.: 13/852,263

(22) Filed: Mar. 28, 2013

(65) Prior Publication Data

US 2013/0264763 A1 Oct. 10, 2013

(30) Foreign Application Priority Data

Apr. 9, 2012 (JP) ..... 2012-88492

(51) Int. Cl.
*B65H 5/00* (2006.01)

(52) U.S. Cl.
USPC ..... 271/2; 271/242

(58) Field of Classification Search
CPC ..... B65H 2701/1916; B65H 2301/331; B65H 9/006
USPC ..... 271/2, 242
See application file for complete search history.

(56) References Cited

U.S. PATENT DOCUMENTS 5,040,781 A * 8/1991 Matoba ..... 271/242
6,168,146 B1 * 1/2001 Komuro et al. ..... 271/10.12
8,636,273 B2 * 1/2014 Saito ..... 271/2

FOREIGN PATENT DOCUMENTS

JP 2011-037486 A 2/2011

* cited by examiner

*Primary Examiner* — Michael McCullough
(74) *Attorney, Agent, or Firm* — Lucas & Mercanti, LLP

(57) ABSTRACT

When conveying an envelope, a posture of the envelope is corrected by hitting a closed portion of the envelope, which is opposite side of an opened portion of the envelope, against a nip portion between upper and lower rollers of the pre-registration rollers and the envelope is then conveyed with the envelope being nipped by the upper and lower rollers of the pre-registration rollers. The upper and lower rollers of the pre-registration rollers nip the envelope to remove air from the envelope. When setting an envelope mode to control a conveying speed of the envelope based on a coverage rate of an image to be formed on the envelope, the conveying speed of the envelope is controlled by adjusting a rotation speed of the registration rollers based on the coverage rate of the set envelope mode.

7 Claims, 7 Drawing Sheets

CONTROL METHOD OF FEEDER AND IMAGE FORMING SYSTEM

CROSS REFERENCE TO RELATED APPLICATION

This application is based on Japanese Patent Application No. 2012-38492 filed with Japanese Patent Office on Apr. 9, 2012, the entire contents of which being hereby incorporated by reference.

BACKGROUND OF THE INVENTION

1. Field of the Invention

The present invention relates to a control method of feeder and an image forming system, which are applied to a production print system (hereinafter, referred to as "PP System").

2. Description of Related Art

In the recent year, the PP system in which large capacity multiple feeders are connected to a color printer, a black/white printer, a copying machine, a multifunction printer thereof or like has been often used in a commercial printing field and/or a printing section in an enterprise. The PP system forms a large number of printed matters including envelopes.

By the way, in the PP system, an attempt to print an illustration of a corporate logo, a corporation name or the like on a plain envelope and then, to execute an image forming job (envelope mode) for printing an address and a destination respectively on the envelope has been made, in order to enable plural species of envelopes to be printed, the feeder corresponding to the plural species of envelopes is desirable for the feeder to be connected to the image forming apparatus.

On the other hand, a demand for the high performance and large capacity feeder has been increased. A feeder having an air section function to enable sheets of paper to float one by one, enable the top sheet of paper to be sucked and enable the sucked sheet of paper to be conveyed to an image forming apparatus has been manufactured.

Regarding the feeder corresponding to the envelope, Japanese Patent Application Publication No. 2011-037486 has disclosed a sealing device and method of controlling the same, in which when ejecting the envelope with it being nipped by a pair of rollers, the envelope is ejected by intermittently repeating the driving and stopping the rollers.

SUMMARY OF THE INVENTION

When setting the envelope mode in the past PP system to print an image, an address and the like on the envelope, the past PP system may deteriorate its print quality on the envelope because the envelope includes an opening and an air enters thereto through the opening so that transfer quality of the image and the like becomes worse and any creases occur. Particularly, when the feeder with the air suction function performs the envelope mode, the air may accidentally enter into the envelope so that an action to remove the air from the envelope may be required.

When a method of ejecting the envelope by intermittently repeating the driving and stopping the rollers, which has been disclosed in Japanese Patent Application Publication No. 2011-037486, is adapted to the envelope mode of the past PP system as it is, a conveying speed of the envelope may be slower without variation in the envelope mode than that of the normal mode thereof.

This invention addresses the above-mentioned issues and has an object to provide an improved control method of feeder and an improved image forming system, which are capable of removing the air from the envelope reproducibly and enhancing flatness of the envelope before the image and the like are printed on the envelope.

To achieve at least one of the above-mentioned objects, a control method of a feeder reflecting one aspect of the present invention, the feeder including a feeding portion which stores a sheet of paper containing an envelope with a predetermined size and feeds the stored sheet of paper, the envelope containing an opened portion and a closed portion, and a pair of registration rollers containing an upper roller and a lower roller, each roller having a longitudinal length longer than a width of the fed sheet of paper, the registration rollers correcting a posture of the sheet of paper fed from the feeding portion to convey the sheet of paper toward a downstream side along a sheet-conveying direction, wherein, when conveying the envelope, the posture of the envelope is corrected by hitting the closed portion of the envelope, which is opposite side of the opened portion of the envelope, against a nip portion between the upper and lower rollers of the registration rollers and the envelope is then conveyed with the envelope being nipped by the upper and lower rollers of the registration rollers, contains a setting step of setting an envelope mode to control a conveying speed of the envelope based on a coverage rate of an image to be formed on the envelope, and a control step of controlling the conveying speed of the envelope by adjusting a rotation speed of the registration rollers based on the coverage rate of the envelope mode set in the setting step.

It is desirable to provide the control method of a feeder wherein during the control step, the coverage rate of the image to be formed on the envelope is compared with a threshold value of the coverage rate as a discriminant criterion thereof, and when the coverage rate of the image to be formed on the envelope exceeds the threshold value, the conveying speed of the envelope is set to be slower than a normal conveying speed or when the coverage rate of the image to be formed on the envelope does not exceed the threshold value, the conveying speed of the envelope is set to be the same speed as the normal conveying speed.

It is also desirable to provide the control method of a feeder wherein during the control step, when the coverage rate of the image to be formed on the envelope exceeds the threshold value, an intermittent rotation control to repeat operations to rotate the registration rollers by a predetermined angle and then to stop the rotation thereof is performed.

In this invention, when conveying the envelope, the posture of the envelope is corrected by hitting the closed portion of the envelope, which is opposite side of one opened portion of the envelope, against a nip portion between the upper end lower rollers of the registration rollers. The envelope is then conveyed with the envelope being nipped by the upper and lower rollers of the registration rollers. The envelope mode to control a conveying speed of the envelope based on a coverage rate of an image to be formed on the envelope is set. The conveying speed of the envelope is controlled by adjusting a rotation speed of the registration rollers based on the coverage rate of the envelope mode.

The concluding portion of this specification particularly points out and directly claims the subject matter of the present invention. However, those skilled in the art will best understand both the organization said method of operation of the invention, together with further advantages and objects thereof, by reading the remaining portions of the specification in view of the accompanying drawing(s) wherein like reference characters refer to like elements.

DETAILED DESCRIPTION OF THE PREFERRED EMBODIMENTS

The following will describe a feeder, a control method of the feeder and an image forming system as the preferred embodiments to carry out the invention with reference to drawings.

Figure 1:
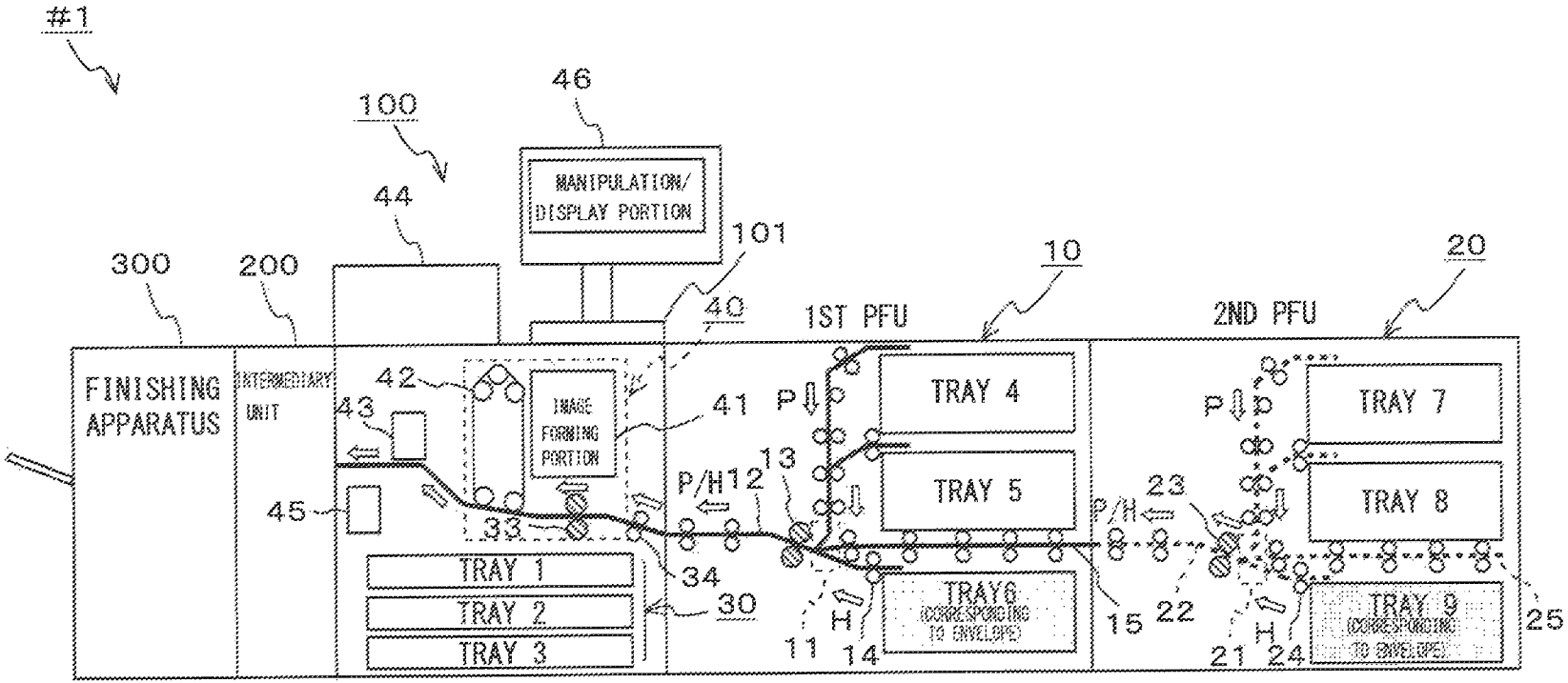
FIG. 1 is a diagram for showing a configuration example of a production print (PP) system as an embodiment of this invention.

A production print system (PP system #1) shown in FIG. 1 constitutes an image forming system. The PP system #1 is a system for producing a large amount of printed matters including envelopes, in which a color printer, a black/white printer, a copy machine, a multifunction apparatus and the like are connected with large capacity feeder(s).

The PP system #1 contains a color copy machine 100, two feeders 10, 20 each corresponding to the envelope mode, an intermediary unit 200 and a finishing apparatus 300. In the envelope mode, a tray containing envelopes of a predetermined size is selected, the envelopes are dispatched one by one and an image is formed on each of the dispatched envelopes. The feeder (a first paper feed unit (PFU)) 10 and the feeder (a second paper feed unit (PFU)) 20 are configured as to be able to connect the color copy machine 100. The feeders are not limited to two in the PP system #1: The feeder more than two feeders may connect the color copy machine 100 in series.

In each of the feeder 10, 20, feeding portions of, for example, three layers are provided. The three layered trays 4 through 6 are provided in the feeder 10. The trays 4 through 6 contain sheets of paper P with a predetermined size or envelopes 50 (see FIGS. 4A and 4B) with a predetermined size. The feeder 10 feeds the sheet of paper P or the envelope 50.

The feeder 10 includes a sheet-switching portion 11, a sheet-conveying path 12, the pre-registration rollers 13, loop rollers 14 and a straight feeding path 15 in addition to three layered trays 4 through 6. In this embodiment, two trays 4 and 5 are arranged over the straight feeding path 15 and the tray 6 corresponding to the envelope is arranged below the straight feeding path 15.

The reason why the tray 6 corresponding to the envelope is arranged below the straight feeding path 15 is because a dispatching path from the lower tray 6 corresponding to the envelope to the sheet-conveying path 12 is gentler than a dispatching path, which is at about right angles, from the upper trays 4 and 5 to the sheet-conveying path 12 and any stress applied to the conveying envelope on the lower tray 6 is weaker than that applied to the conveying envelope on the upper trays 4 and 5. The envelopes are stacked and contained in the tray 6 with opened portions of the envelopes being aligned and facing toward an upstream side along a sheet-conveying direction.

The sheet-switching portion 11 is positioned at a downstream side of the above-mentioned trays 4 through 6 along the sheet-conveying direction. The sheet-switching portion 11 selects any one of the trays 4 through 6, based on information for controlling the feeding, to connect the selected tray to the sheet-conveying path 12. The sheet-switching portion 11 is provided with gate switching plates, solenoid as driving source and the like, which are not shown. The sheet-conveying path 12 extends from the sheet-switching portion 11 to the color copy machine 100. The sheets of paper or the envelopes 50 are conveyed on the sheet-conveying path 12 at their predetermined conveying speed. There are plural conveying rollers, not shown, on the sheet-conveying path 12.

The pre-registration rollers 13 constituting the registration rollers are arranged on the way to the sheet-conveying path 12. The pre-registration rollers 13 correct a posture of the sheet of paper fed from the tray 4 or 5 selected by the sheet-switching portion 11 or the envelope 50 fed from the tray 6 selected by the sheet-switching portion 11. The pre-registration rollers 13 are connected with a motor driving portion 18 shown in FIG. 6. The motor driving portion 18 drives the pre-registration rollers 13 to rotate them to predetermined directions.

Figure 2:
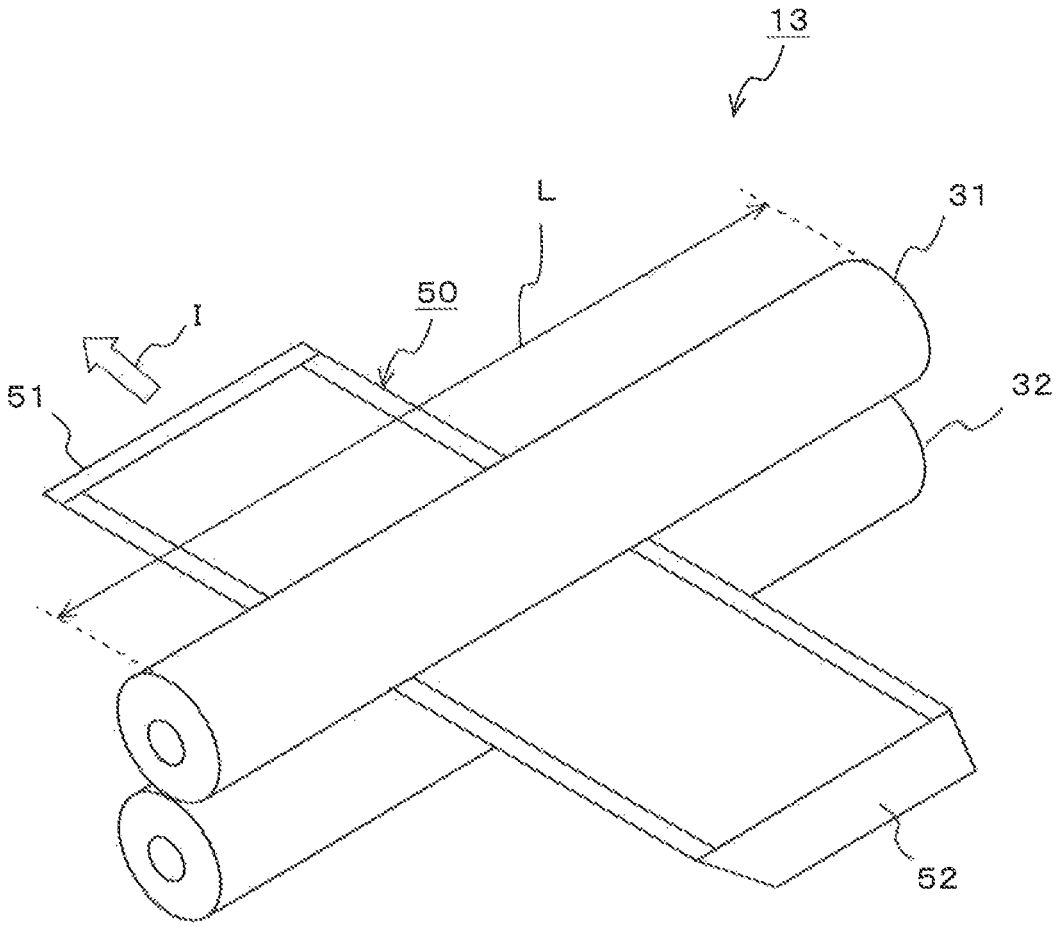
FIG. 2 is a perspective view of pre-registration rollers showing an example of removing air from the envelope.

The pre-registration rollers 13 are comprised of an upper roller 31 and a lower roller 32, each roller having a predetermined roller width (longitudinal length) L shown in FIG. 2. The roller width L defines a region (hereinafter, referred to as "sheet-conveying region") along a width direction of the sheet of paper P, is longer than a width of the envelope 50 and is a length that is equal to a sheet width of the sheet of paper with maximum size which is able to be contained in the trays 4 through 6. The upper roller 31 is a long driven roller which is one roller and the lower roller 32 is a long driving roller which is one roller. Thus, the pre-registration rollers 13 are configured by the upper roller 31 and the lower roller 32, each of which is one rod-like roller and has a uniform roller diameter within the sheet-conveying region.

The loop rollers 14 are arranged at an upstream side of the pre-registration rollers 13 along the sheet-conveying direction. The loop rollers 14 operate to hit the envelope 50 against the pre-registration rollers 13 to allow the envelope 50 to flex so that the posture of the envelope 50 can be corrected. For example, when selecting the tray 6 containing the envelopes 50, the closed portion the envelope 50, which is opposite side of the opened portion of the envelope, is hit against a nip portion between the upper roller 31 and the lower roller 32, which are stopped, by driving the loop rollers 14. This enables the closed portion of the envelope 50 to be corrected to a direction which is almost perpendicular to the sheet-conveying direction (Pre-registration function).

The pre-registration rollers 13 then drive so that the envelope 30 passes through the nip portion so as to be conveyed on the sheet-conveying path 12 with the envelope being nipped by the upper roller 31 and the lower roller 32. This enables air to be removed from the envelope 50 by nipping the envelope 50 by the upper roller 31 and the lower roller 32 of the pre-registration rollers 13. In other words, when the envelope 50 is passed through the path in which the envelope 50 is nipped by the upper roller 31 and the lower roller 32 of the pre-registration rollers 13 in each of the feeders 10, 20, the air may be removed from the envelope 50 so that flatness of the envelope 50 is enhanced to improve print quality (first envelope corresponding control example).

In the feeder 20, three layered trays 7 through 9 are also provided. The feeder 20 contains a sheet-switching portion 21, a sheet-conveying path 22, pre-registration rollers 23 and loop rollers 24. Since the elements of the feeder 20 having like name of these of the feeder 10 have like functions, the detailed explanation thereof will be omitted. In this embodiment, the tray & corresponds to the envelope mode in the feeder 20.

The color copy machine 100 constituting an image forming apparatus is connected to the above-mentioned feeder 10 at a downstream side thereof along the sheet-conveying direction. The color copy machine 100 includes a main body 101 thereof. The main body 101 of the color copy machine 100 contains a feeding portion 30, an image forming portion 41, an intermediate transfer belt 42, a fixing portion 43, a scanner 44, a control portion 45 and a manipulation/display portion 46.

The feeding portion 30 is installed at a predetermined position in the main body 101 of the color copy machine 100. The feeding portion 30 contains three layered strays 1 through 3. Each of the trays 1 through 3 contains sheets of paper with a predetermined size and each of the trays 1 through 3 feeds the sheet of paper with the predetermined size to the image forming portion 41 similar to the two feeders 10, 20.

The scanner 44 and the manipulation/display portion 46 sore positioned on the main body 101 of the color copy machine 100. The manipulation/display portion 46 allows a user to manipulate a screen thereof to set the envelope mode and/or image forming conditions. The image forming conditions include normal nods/envelope mode, printing mode (single-side printing/duplex printing), a species of the sheet such as the sheet of paper P and the envelope 50, their paper weight, the trays 4 through 9, image forming mode (monochrome/color), a sheet size, an envelope size, page number, a number of copies and the like.

The scanner 44 contains a line image sensor (hereinafter, referred to as "CCD") constituting a document image scanning and exposing apparatus, not shown. The CCD reads the document based on the read instruction from the manipulation/display portion 46 and outputs the read image data to the control portion 43.

The image forming device 40, the fixing portion 43 and the control portion 45 are installed at predetermined positions in the main body 101 of the color copy machine 100. The image forming device 40 contains registration rollers 33, loop rollers 34, the image forming portion 41 and the intermediate transfer belt 42. The image forming portion 41 receives the image data from the control portion 45 and forms a color image or a black/white image on the sheet of paper P, the envelope 50 or the like fed from the feeding portion 30, the feeders 10, 20 and the like based on an image forming job. The image forming portion 41 ejects the sheet of paper P or the envelope 50, on which the color or black/white image has been formed, to the intermediate unit 200.

The image forming portion 41 uses, for example, an electrophotographic printer engine of tandem type. The image forming portion 41 converts image data of RGB system to image data of YMCK system. The image forming portion 41 forms a color toner image based on the image data on the converted yellow (Y), the converted magenta (M), the converted cyan (C) and the converted black (BK).

The image forming portion 41 contains image forming units respectively taking charge of the forming of the images of Y, M, C and BK colors. In the image forming portion 41, a charging unit uniformly charges the photosensitive drum for every image forming color. The charged photosensitive drum is exposed and an electrostatic latent image can be formed on the photosensitive drum based on image data. The developing device develops the electrostatic latent image for every image-forming color. These charge, exposure and development are performed for every image-farming color so that each toner image can be formed on the photosensitive drams on every image-forming color. The formed toner images are fitted on each other on the intermediate transfer belt 42. The transfer portion transfers the fitted color toner images on the sheet of paper P, the envelope 50 or the like. In the printing of the envelope mode, the process conditions such as the development, the transfer and the like are changed to process conditions that are special to the envelope printing in which the envelope 10 is printed.

The registration rollers 33 and the loop rollers 34 are arranged on the feeding portion 30. Since these functions are the same as the functions of the pre-registration rollers 13 and the loop rollers 14, the explanation thereof will be omitted. The sheet of paper P is conveyed from the trays 4, 5 of the feeder 10 and the trays 7, 8 of the feeder 20 to the transfer portion. The envelope 50 is conveyed from the tray 6 of the feeder 10 and the tray 9 of the feeder 20 to the transfer portion.

The fixing portion 43 fixes the toner image transferred on the desired sheet of paper P, the desired envelope 50 or the like. In the printing of the envelope mode, the fixing condition is changed to the fixing condition that is special to the envelope printing in which the envelope 50 is printed. The fixed sheet of paper P or the fixed envelope 50 is ejected from the color copy machine 100. This enables the color image or the black/white image based on the image data to be formed on the desired sheet of paper P or the desired envelope 50.

In this embodiment, the intermediary unit 200 is connected to the color copy machine 100 at a downstream side thereof along the sheet-conveying direction. The intermediary unit 200 stacks the sheets of paper P and/or the envelopes 50, on which the image has been formed, ejected from the color copy machine 100. In such a stacking process, plural sheets of paper P and/or plural envelopes 50, on which the image has been formed, are bundled. The finishing apparatus 300 is connected to the intermediary unit 200 at a downstream side thereof along the sheet-conveying direction. The finishing apparatus 300 performs, for example, a staple processing on the bundle of sheets of paper P. The finishing apparatus 300 then ejects stapled booklets.

Figure 3:
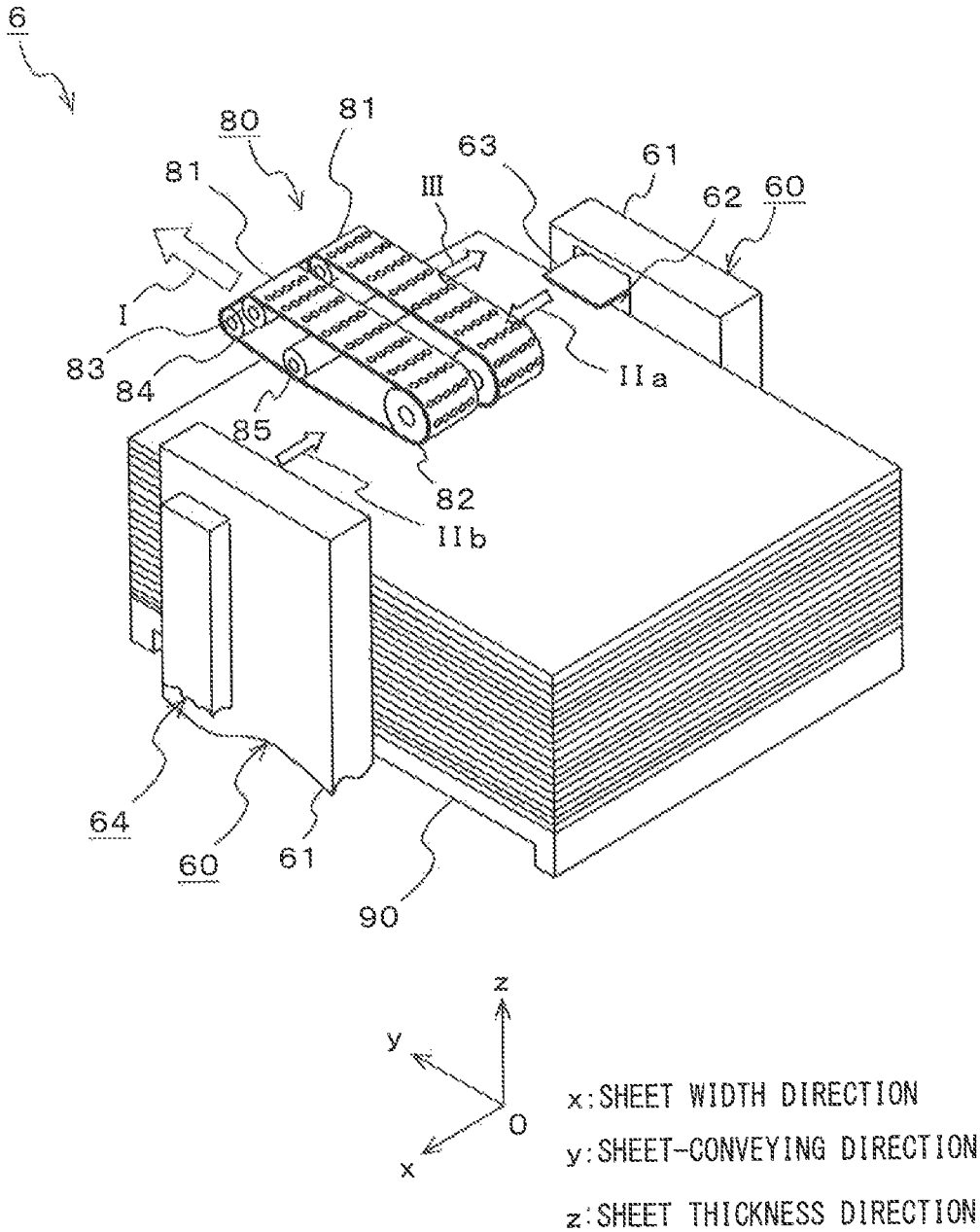
FIG. 3 is a perspective view of a tray showing a configuration example of an air suction mechanism.

The following will describe a configuration example of an air suction mechanism in the tray 6 or the like with reference to FIG. 3. The tray 6 corresponding to the envelope has the air suction mechanism as shown in FIG. 3. The air suction mechanism operates to allow the top sheet of paper P (or the top envelope 50) of the sheets of paper P (the stacked envelopes 50) mounted on a sheet-mounting base 90, which can be elevated, to float and to be sucked. The air suction mechanism also operates to allow the floated and sucked sheets of paper P or envelopes 50 to be sent in order (air suction function).

For example, the tray 6 contains air-blowing side portions 60 and a sheet-sucking-and-conveying portion 80. Each of the air-blowing side portions 60 is positioned so as to face the side of the bundle of the sheets of paper P mounted on the sheet-mounting base 90 on the basis of the sheet-conveying direction I (=y) as shown in FIG. 3. The air-blowing side portions 60 blow air to the sides of the bundle of the sheets of paper P or the like from each side as shown by arrows IIa and IIb in white on x direction; along a sheet width direction x (which is almost perpendicular to the sheet-conveying direction y) in order to allow the top sheet of paper P or the like to float upward on the sheet-mounting base 90 (along a sheet thickness direction z, namely, vertical direction z, which is perpendicular to each of the directions x and y).

Each of the air-blowing side portions 60 contains a duct main body 61, a telescopic duct 62, an air-blowing-opening-elevating portion 64 and the like. The duct main body 61 and the telescopic duct 62 lead the air for allowing the top sheet of paper or the like to float to an air-blowing opening. A bent guide portion 63 is arranged on the telescopic duct 62 so as to be positioned in an upper part of the air-blowing opening. Each of the air-blowing aide portions 60 blows the air to the side of the bundle of the sheets of paper P or the like along the guide portion 63, as shown by arrows IIa and IIb in white of FIG. 3.

This air blown to the side of the sheets of paper or the like allows the top sheet of paper P or the like of the sheets of paper or the like mounted on the sheet-mounting base 90 to float and separate from the remained sheets of paper or the like. The air-blowing-opening-elevating portion 64 is provided on the back surface of each of the air-allowing side portions 60. The air-blowing-opening-elevating portion 64 elevates the telescopic duct 62 and the guide portion 63, which communicate the air-blowing opening to decide an air blowing position, vertically (along the sheet thickness direction z).

The sheet-sucking-and-conveying portion 80 is arranged over the sheets of paper or the like mounted on the sheet-mounting base 90. The sheet-sucking-and-conveying portion 80 sucks the floated sheet of paper P or the like based on the air IIa, IIb using suction air III and conveys it in order. The sheet-sucking-and-conveying portion 80 contains a pair of conveying belts 81, 81. Each of the conveying belts 81, 81 sucks the top sheet of paper P or the like of the sheets of paper or the like mounted on the sheet-mounting base 90. The pair of conveying belts 81, 81 conveys the sucked top sheet of paper P or the like to the color copy machine 100 in order.

The sheet-sucking-and-conveying portion 80 also contains driving rollers 82 and guide rollers 83, 84 and 85 in addition to the conveying belts 81, 81. Belt-driving portion, not shown, rotates the conveying belts 81, 81 clockwise to run on the driving rollers 82 and the guide rollers 83, 84 and 85. In the tray 6, the sheet-mounting base 90, the air-blowing side portions 60, the air-blowing-opening-elevating portion 64 and the sheet-sucking-and-conveying portion 80 constitute a sheet-sucking-and-conveying system. In the tray 9, the sheet-sucking-and-conveying system which is similar to that of the tray 6 is also constituted.

Figure 4A:
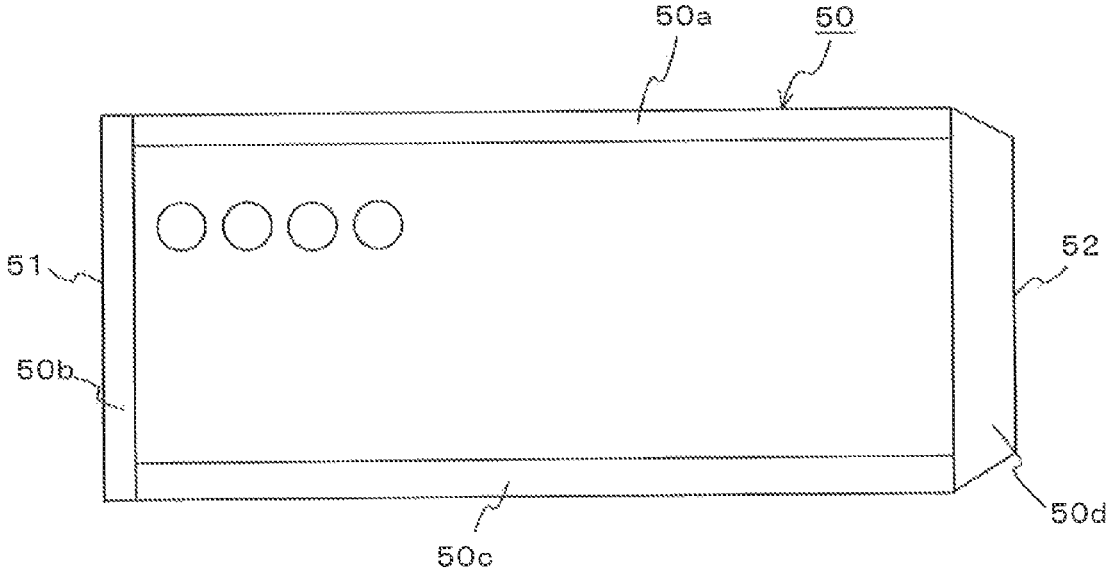
FIG. 4A is a diagram showing an appearance example of a back side of the envelope and FIG. 4B is a diagram showing an appearance example of a front side of the envelope.
Figure 4B:
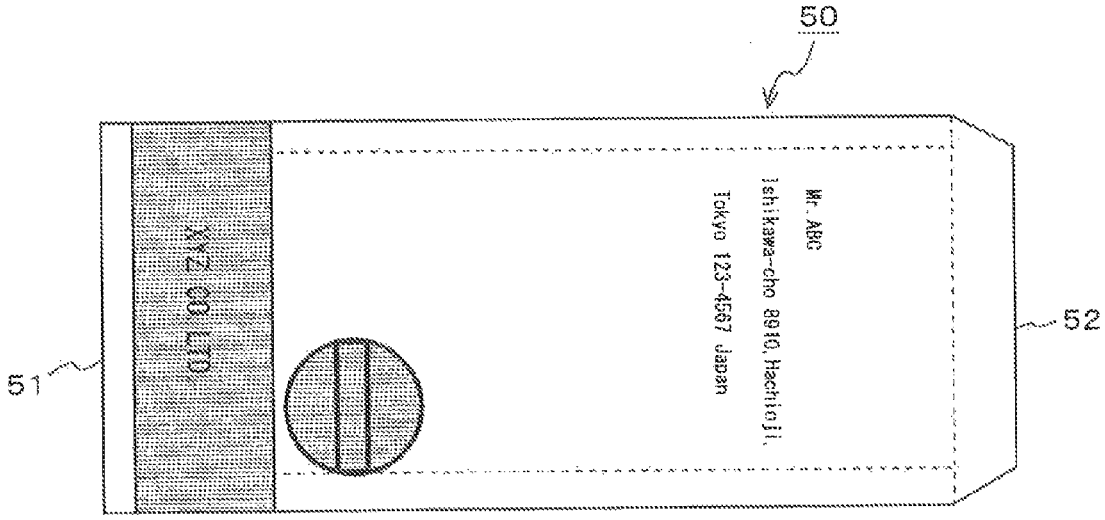

The following will describe appearances of a front side and a back side of the envelope 50 with reference to FIGS. 4A and 4B. FIG. 4A shows an appearance of the back side of the envelope 50. The envelope 50 is composed of, for example, folded and glued parts 50*a*, 50*b* and 50*c* and a seal part 50*d*. In the folded and glued parts 50*a*, 50*b* and 50*c*, sheets for envelope are overlapped trebly. Thus, the folded and glued parts 50*a*, 50*b* and 50*c* have thickness thicker than that of the seal part 50*d*. The seal part 50*d* constitutes an opened portion 52 of the envelope 50, and the folded and glued part 50*b*, which is opposite side of the opened portion 52 of the envelope 50, constitutes a closed portion 51 of the envelope 50.

In this embodiment, the tray 6 or the like contains the envelopes 50 with, the opened portions 52 of the envelopes 50 facing to the upstream side along the sheet-conveying direction and being aligned. When any air suction function is applied to the above-mentioned tray 6 or the like corresponding to the envelope, it is configured that if air enters into the envelope 50 through the opened portions 52 thereof accidentally, the pre-registration rollers 13 removes the air from the envelope 50.

It is to be noted that on the back side of the envelope 50 for company or business, a name and an address of the sender are normally printed by mono-chrome ink as shown in FIG. 4A. On the other hand, on the front side of the envelope 50 therefor, as shown in FIG. 4B, a name and an address of a destination, logo mark of the company or business which sends the envelope, and/or illustrated image(s) including a company name or a company address are often printed in color.

Figure 5A:
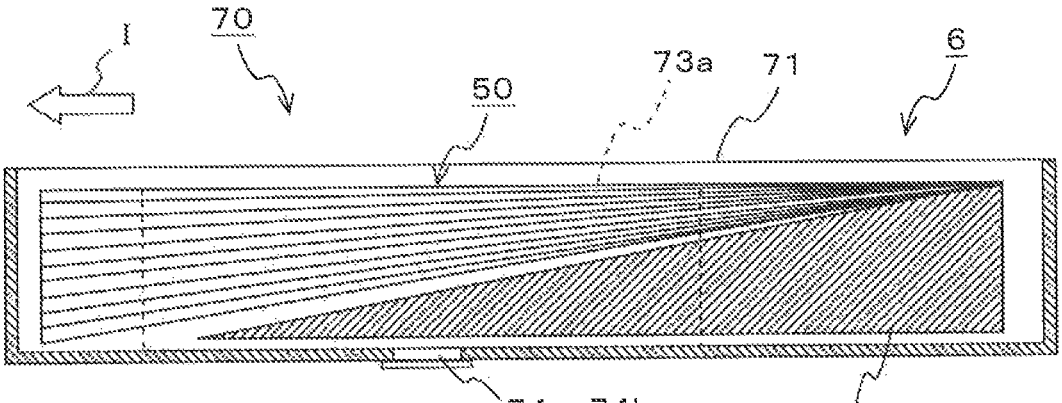
FIG. 5A is a sectional view of an envelope special kit in the tray and FIG. 5B is a front view of the envelope special kit in the tray.

When plural envelopes 50 are stacked with each other in the tray 6 or the like, the thickness of the bundle of the envelopes 50 becomes thicker at the side of the closed portions 51 thereof than that of the side of the opened portions 52 thereof because the closed portion 51 of each of the envelopes 50 have folded parts (see FIG. 5A). As a result thereof, under certain circumstances, the stacked envelopes 50 may be inclined. Accordingly, an envelope special kit 70 is prepared in order to correct the inclination of the envelope 50 and to maintain the flatness of the top envelope 50.

Figure 5B:
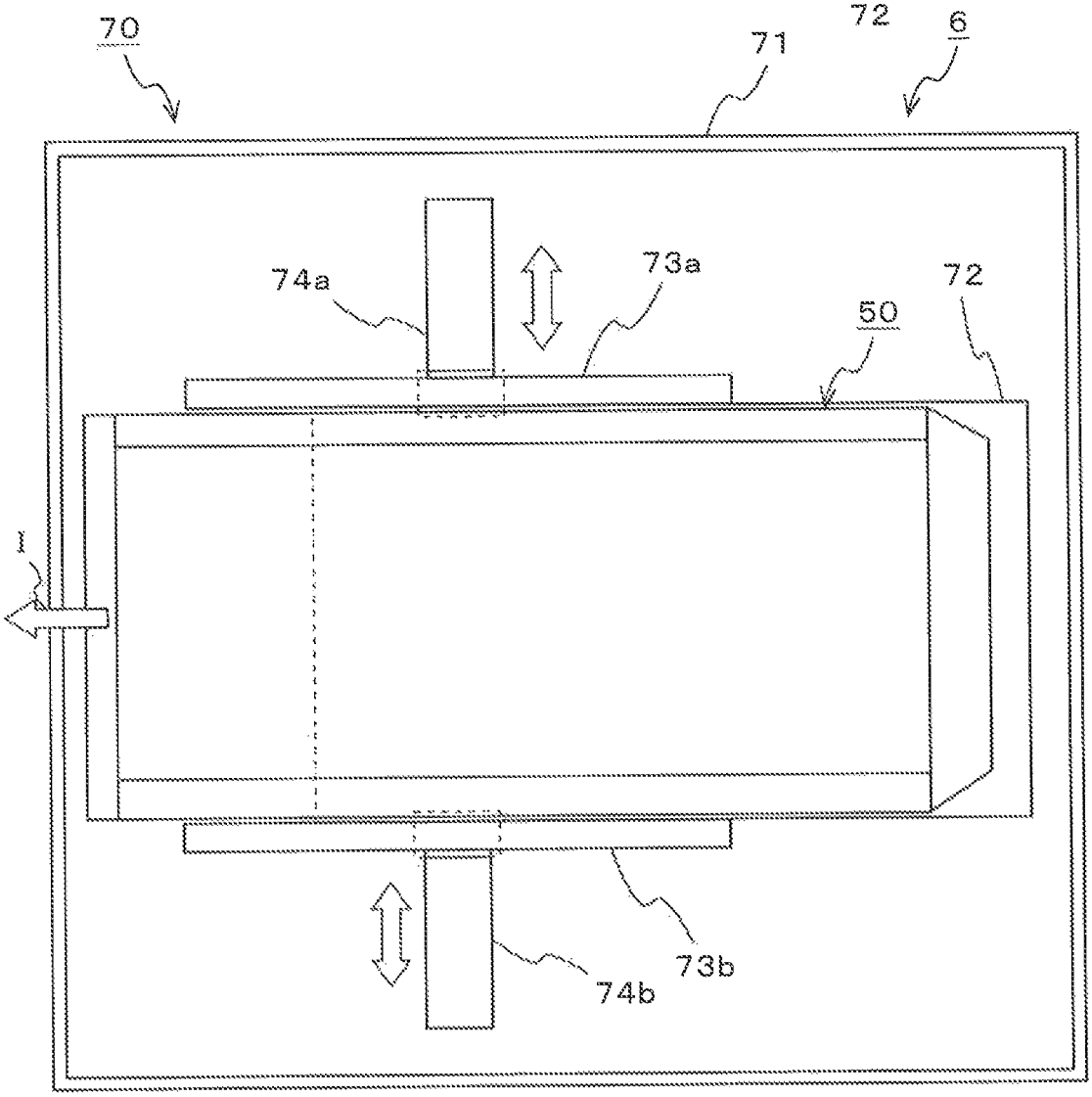

The following will describe the envelope special kit 70 in the tray 6 with reference to FIGS. 5A and 5B. According to the envelope special kit 70 shown in FIGS. 5A and 5B, a tray main body 71 is provided with a height-adjusting member 72 and special guide plates (guide members) 73*a*, 73*b*. The sheet-mounting base 90 mounts the tray main body 71 and the height-adjusting member 72 is provided in the tray main body 71. The envelopes 50 are contained on the height-adjusting member 72 in the tray 6 with the opened portions 52 of the envelopes 50 facing to the upstream side along the sheet-conveying direction and being aligned.

The height-adjusting member 72 adjusts a height of the bundle of the envelopes 50 mounted in the tray main body 71. As the height-adjusting member 72, a raised bottom plate having a triangular section and a gentle down slope inclined along a direction (the sheet-conveying direction) from the opened portions 52 of the envelopes 50 to the closed portion 51 thereof is used. Further, in order to maintain the flatness of the top envelope 50, an upper surface of the height-adjusting member 72 may be formed so as to be a circular arc on the width direction of the envelope 50. Such an arc-shaped member can smooth out the thickness increased by the folded parts of both sides of the envelope 50 to cancel the influence by the increased thickness thereof.

The special guide plates 73*a*, 73*b* are installed in openings 74*a*, 74*b* provided on a bottom surface of the tray main body 71 along the sheet width direction so as to be slidable. The special guide plates 73*a*, 73*b* guide the envelopes 50, a height of which is adjusted by the height-adjusting member 72, to a predetermined direction. In this moment, a user adjusts the envelopes 50 so that the special guide plates 73*a*, 73*b* push sides of the bundle of the envelopes 50 along the openings 74*a*, 74*b*. Thus, whole of the PP system #1 is configured.

Figure 6:
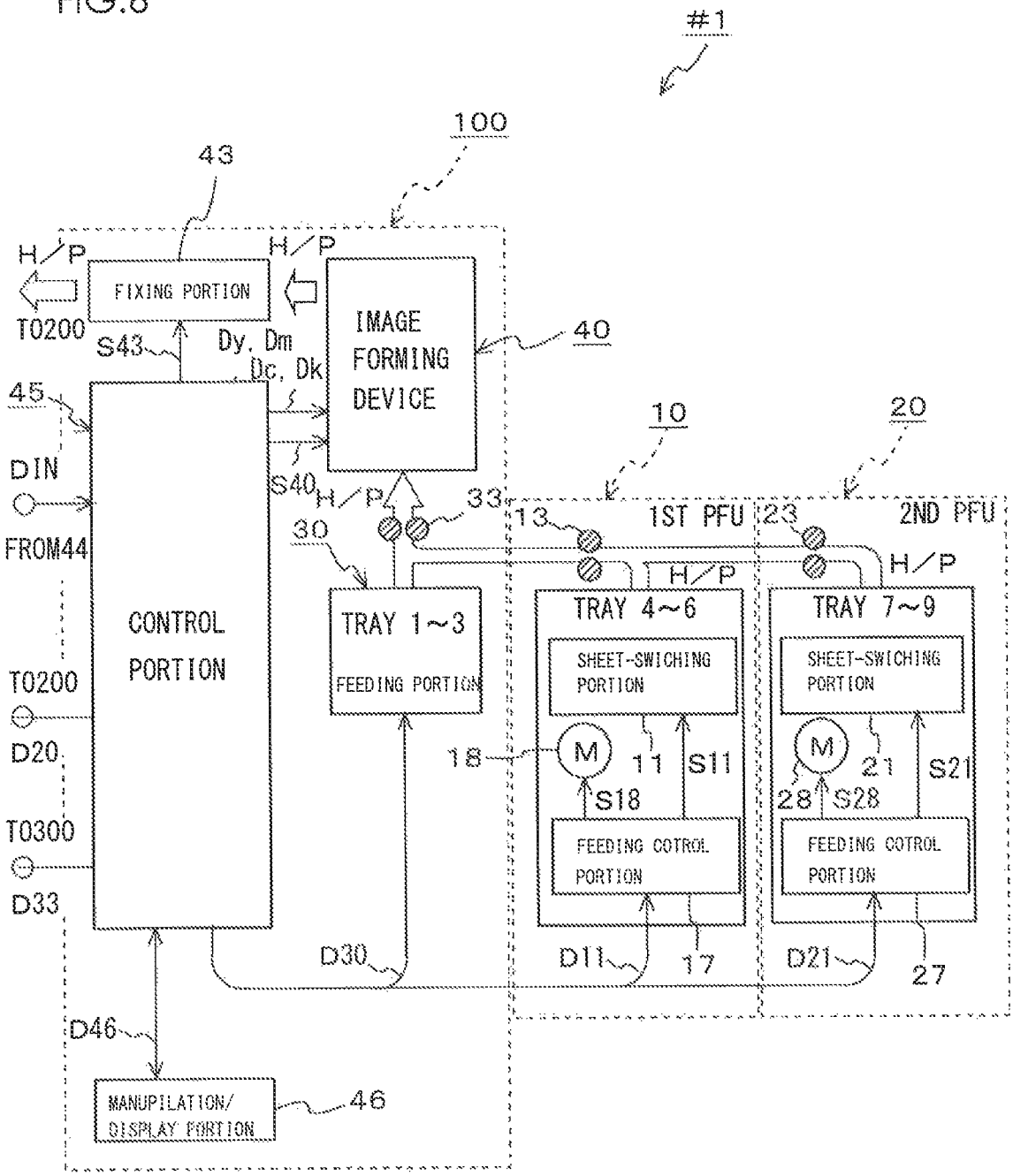
FIG. 6 is a block diagram of the PP system showing a configuration example of a control system thereof.

The following will describe a configuration example of a control system in the PP system #1 with reference to FIG. 6. In this embodiment, in the envelope 50 shown in FIG. 4A, a printed image such as the name and address of the sender by monochrome ink has a low coverage rate. In the envelope 50 shown in FIG. 4B, an image such as logo mark and the like printed in color has a high coverage rate. Accordingly, the control portion 45 is configured so as to automatically set air-removing conditions according to the coverage rate of the image to be printed on the envelope 50 when setting the envelope mode.

According to the control system in the PP system #1 shown in FIG. 6, for example, the color copy machine 100 controls inputs/outputs of the feeders 10, 20, the intermediary unit 200 and the finishing apparatus 300. The color copy machine 100 contains the feeding portion 30, the image forming device 40, the fixing portion 43, the control portion 45 and the manipulation/display portion 46.

When controlling the trays 6 and 9 corresponding to the envelope mode, namely, controlling the conveyance of the envelope from the feeders 10, 20 to the color copy machine 100, the control portion 45 control a conveying speed of the envelope 50 (this envelope is shown as the envelope H in FIG. 6) based on the coverage of the image to be formed on the envelope 50 by the image forming portion 41.

In this embodiment, the control portion 45 receives the setting of the envelope mode and controls rotation speed of the pre-registration rollers 13 based on the coverage rate of the received setting of envelope mode to adjust the conveying speed of the envelope 50. This enables the conveying speed of the envelope 50 to be changed (to variable speed pattern or intermittent pattern) according to printing contents (coverage, printing position or the like) of the image to be printed on the envelope 50 (second envelope corresponding control example).

The control portion 45 receives (acquires), for example, information about the coverage rate of the image to be printed on the envelope 50. Since the information, about the coverage rate is described in header information constituting an image forming job during the envelope mode, the control portion 45 may acquires lure information about the coverage rate by decoding the header information.

The control portion 45 compares the coverage rate of the image to be ferried on the envelope 50 with a previously set threshold value of the coverage rate as a discriminant criterion thereof. When the coverage rate of the image to be formed on the envelope is low coverage rate so that it does not exceed the threshold value, the control portion 45 sets the conveying speed of the envelope 50 so as to be (almost) the same speed as the normal conveying speed of the sheet of paper P (the normal conveying speed).

In other words, when setting an image forming job of low coverage in which there is a little coverage region on the envelope 50, the control portion 45 controls the feeder 10 to feed the envelope 50 from the tray 6 to the pre-registration rollers 13 at a sheet-conveying speed corresponding to the envelope and to feed the envelope 50 without decreasing the conveying speed of the envelope thereafter, which enhances productivity.

When the coverage rate of the image to be formed on the envelope 50 is high coverage rate so that it exceeds the threshold value, the control portion 45 sets the conveying speed of the envelope 50 so as to be slower than the normal conveying speed of the sheet of paper P (variable speed pattern).

In other words, when setting an image forming lob of high coverage in which there is a large coverage region on the envelope 50, the flatness of a surface of the envelope is required so that it is necessary to remove air from the envelope carefully so that uniformity of the surface of the envelope to be printed is maintained. Accordingly, the control portion 45 controls the pre-registration rollers 13 to drive and stop them or to decrease the sheet-conveying speed so that the air can be removed from the envelope 50.

For example, the control portion 45 controls the pre-registration rollers 13 to perform an intermittent rotation (the intermittent pattern) so that the envelope 50 is intermittently conveyed to remove the air from the envelope 50. This enables to be selected the envelope mode in which the envelopes 50 are changeably conveyed based on the printing contents of the image to be formed on the envelope 50.

The feeder 10 contains a sheet-switching portion 11, a feeding control portion 17 and a motor-driving portion 18. To the above-mentioned control portion 45, the feeding control portion 17 of the feeder 10 is connected through a special communication cable, not shown. The feeding control portion 17 decodes feeding control data D11 to generate a tray selection signal S11 and a motor control signal S18.

The feeding control data D11 is information for controlling the feeder 10 and the control portion 45 outputs the feeding control data D11 to the feeding control portion 17.

The feeding control portion 17 is connected to the sheet-switching portion 11. The sheet-switching portion 11 selects any one of the trays 4 through 6 based on the tray selection signal S11 and connects the selected tray to the sheet-conveying path 12. When setting the envelope mode, the sheet-switching portion 11 selects the tray 6 and connects it to the sheet-conveying path 12.

To the feeding control portion 17, the motor-driving portion 18 is connected in addition to the sheet-switching portion 11. The motor-driving portion 18 rotates the pre-registration rollers 13 at a sheet-conveying speed of the sheet of paper P which corresponds to the setting of the sheet-conveying speed to 1/1 or ½ based on the motor control signal S18 to convey the envelope 50 on the sheet-conveying path 12. For example, when the coverage rate of the image to be formed on the envelope 50 is high coverage rate so that it exceeds the threshold value, the feeding control portion 17 controls the motor-driving portion 18 to perform an intermittent rotation control to repeat operations to rotate the pre-registration rollers 13 by a predetermined angle and then to stop the rotation thereof.

The feeder 20 contains the sheet-switching portion 21, the feeding control portion 27 and the motor-driving portion 28. Since the elements of the feeder 20 having like name of these of the feeder 10 have like functions, the detailed explanation thereof will be omitted. The sheet-switching portion 21 is provided at downstream side of the trays 7 through 2 along the sheet-conveying direction. The sheet-switching portion 21 selects any one of the trays 7 through 9 based on feeding control data D21 and connects the selected tray to the straight feeding path 15 of the feeder 10.

To the control portion 45, the feeding portion 30 is connected. The control portion 45 controls the feeding portion 30 to select any of the trays 1 through 3 based on the feeding control data D30 to convey the sheet of paper P to the image forming device 40 therefrom. The feeding control data D30 is data for selecting any of the trays 1 through 3 and the control portion 45 outputs the feeding control data D30 to the feeding portion 30.

To the control portion 45, the image forming device 40 is connected. The image forming device 40 forms a color image based on image data Dy, Dm, Dc, Dk and an image forming control signal S40. The image data Dy, Dm, Dc, and Dk is data for forming the color image, which is obtained by performing any image processing on image read data Din obtained from the scanner 44, on the sheet of paper P or the envelope 50. The image forming control signal S40 is a signal for controlling image forming timing in the image forming device 40. The control portion 45 outputs the image data Dy, Dm, Dc, DK and the image forming control signal S40 to the image forming device 40.

To the control portion 45, the fixing portion 43 is connected. The fixing portion 43 fixes the sheet of paper P or the envelope 50, on which the image has formed, based on a fixing control signal S43. In the envelope mode, a fixing device is exchanged to a special fixing device for fixing the envelope 50. The fixing control signal S43 is a control signal used when the toner image is fixed which is transferred to the sheet of paper P or the envelope 50. The control portion 45 outputs the fixing control signal S43 to the fixing portion 43.

To the control portion 45, the manipulation/display portion 46 is connected. The user manipulates the manipulation/display portion 46 to select, when setting the sheet of paper, any of the trays 1 through 3 of the feeding portion 30 containing the sheets of paper P, any of the trays 4, 5 of the feeder 10, any of the trays 7, 8 of the feeder 10, the tray 6 corresponding to the envelope in the feeder 10, the tray 9 corresponding to the envelope in the feeder 20 or the like. The manipulation/display portion 46 outputs to the control portion 45 manipulation data D46 containing tray selection instruction, the envelope mode, image forming conditions (process conditions) and the like. In the envelope mode, feeding conditions, image forming conditions and/or the like are changed to the envelope special conditions and setting items for the envelope mode can be set.

It is to be noted that the control portion 45 outputs intermediary control data D20 to the intermediary unit 200 to perform a stack control and the control portion 45 outputs finishing control data D33 to the finishing apparatus 300 to perform a finishing control. Thus, the control system of the PP system #1 is configured.

Figure 7:
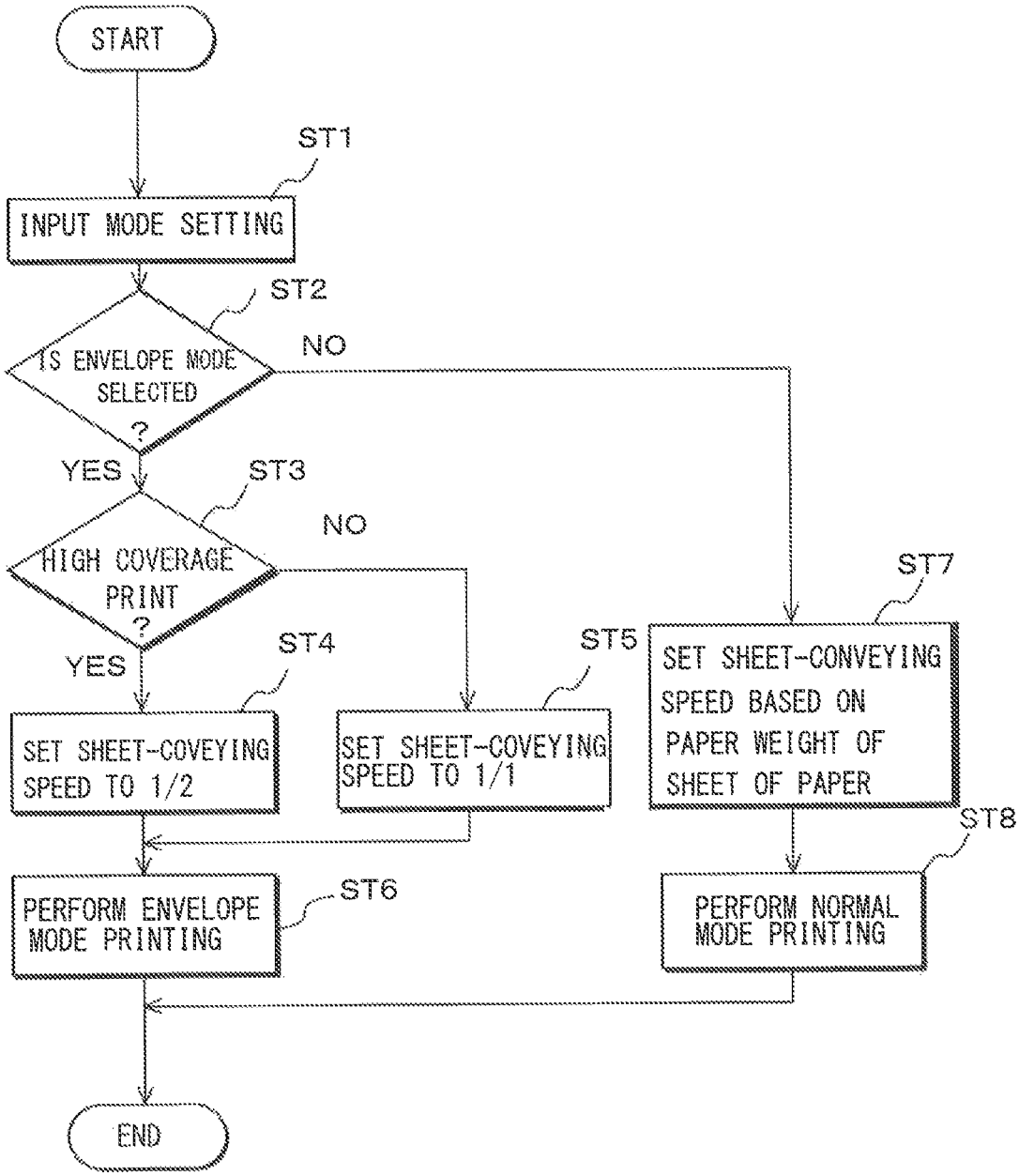
FIG. 7 is a flowchart for showing a control example of the PP system when it corresponds to an envelope mode.

The following will describe a control example of the PP system #1 when it corresponds to the envelope mode in relation to a control method of the feeders 10, 20 according to an embodiment of this invention, with reference to FIG. 7. In this embodiment, the control portion 45 receives setting of the envelope mode in which the conveying speed of the envelope 50 is controlled based on a coverage rate of the image to be formed on the envelope 50. The control portion 50 adjusts a rotation speed of the pre-registration rollers 13 based on the coverage rate of the received envelope mode to control the conveying speed of the envelope 50. Of course, on the way of feeding the envelope from the feeder 10 or 20, the upper roller 31 and the lower roller 32 used in the pre-registration rollers 13 of the feeder 10 or the pre-registration rollers 23 of the feeder 20 nip the envelope 50 to remove the air from the envelope 50.

At a step ST1 shown in FIG. 7, the control portion 45 receives setting of the envelope mode or the normal mode. In this moment, the user matriculates the manipulation/display portion 46 to set the envelope mode or the normal mode. When one envelope mode is set, the fray 6 or 9 is selected. In this embodiment, the tray 6 corresponding to the envelope is selected.

When the normal mode is set, any of the trays 1 through 5, 7 and 8 is selected. When the normal mode is set, the user also sets paper weight of the sheet of paper P. When the paper weight is within a range of 64 through 135 g/m$^2$, the control portion 45 sets the sheet-conveying speed, to 400 mm/s (corresponding to the normal sheet-conveying speed (1/1)). When the paper weight is within a range of 136 through 300 g/m$^2$, the control portion 45 sets the sheet-conveying speed to 300 mm/s (corresponding to three fourths (¾) of the normal sheet-conveying speed). When the paper weight is within a range of 301 through 350 g/m$^2$, the control portion 45 sets the sheet-conveying speed to 200 mm/s (corresponding to a half (½) of the normal sheet-conveying speed). When setting the envelope mode, the control portion 45 sets the conveying speed of the envelope to a half (½) of the normal sheet-conveying speed.

At a step ST2, the control portion 45 determines whether or not the envelope mode is set. When setting the envelope mode, at a step ST3, the control portion 45 determines whether or not a high coverage printing is used based on the image to be formed on the envelope 50. When the envelope is the envelope 30 shown in FIG. 4B, the high coverage printing is used based on the image of the front surface of this envelope 50.

When printing the image shown in FIG. 4B on the envelope 50 using the high coverage printing, at a step ST4, the control portion 45 controls the pre-registration rollers 13 to set the conveying speed of the envelope to a half of the normal sheet-conveying speed. In this moment, the control portion 45 outputs to the feeding control portion 17 the feeding control data D11 such that the conveying speed of the envelope is set to a half of the normal sheet-conveying speed.

The feeding control portion 17 decodes the feeding control data D11 to generate the motor control signal S18 such that the conveying speed of the envelope is set to a half of the normal sheet-conveying speed. The motor driving portion 18 rotates the pre-registration rollers 13 at the conveying speed of the envelope, which corresponds to a half of the normal sheet-conveying speed, based on the motor control, signal S18. This enables the envelope 50 to be conveyed on the sheet-conveying path 12 at the conveying speed of the envelope, 200 mm/s, which corresponds to a half of the normal sheet-conveying speed. In this moment, the envelope 50 is nipped by the pre-registration rollers 13 to remove the air from the envelope 50 slowly and carefully.

At a step ST6, the control portion 45 controls the image forming device 40 to print the image under the envelope mode. The image forming device 40 forms the color image on the envelope 50 conveyed by the pre-registration rollers 13 based on the image data Dy, Dm, Dc, Dk and the image forming control signal S40. The control portion 45 also control the fixing portion 43 to fix the envelope 50 on which the color image has been formed based on the fixing control signal S43. The control portion 45 outputs the intermediary control, data D20 to the intermediary unit 200 to perform a stack control.

When the control portion 45 determines that a high coverage printing is not used based on the image to be formed on the envelope 50, namely, a low coverage printing is used, at a step ST5, the control portion 45 controls the pre-registration rollers 13 to set the conveying speed of the envelope to the normal sheet-conveying speed (1/1). In this moment, the control portion 45 outputs to the feeding control portion 17 the feeding control, data D11 such that the conveying speed of the envelope is set to the normal sheet-conveying speed.

The feeding control portion 17 decodes the feeding control data D11 to generate the motor control signal S18 such that the conveying speed of the envelope is set to the normal sheet-conveying speed (1/1). The motor driving portion 18 rotates the pre-registration rollers 13 at the convoying speed of the envelope, which corresponds to the normal sheet-conveying speed (1/1), based on the motor control signal S18. This enables the envelope 50 to be conveyed on the sheet-conveying path 12 at the conveying speed of the envelope, 400 mm/s, which corresponds to the normal sheet-conveying speed (1/1). In this moment, the envelope 50 is nipped by the pre-registration rollers 13 to remove the air from the envelope 50 faster than a case of the nigh coverage printing.

At the step ST6, the control portion 45 then controls the image forming device 40 to print the image under the envelope mode and controls the fixing portion 43, the intermediary unit 200 and the like (see the above-mentioned step ST6).

When, at the step ST2, the control portion 45 determines that the normal mode is set, at a step ST7, the control portion 45 controls the pre-registration rollers 13 to set the sheet-conveying speed according to the paper weight of the sheet of paper. For example, when the paper weight is within a range of 136 through 300 g/m$^2$, the control portion 45 sets the sheet-conveying speed to 300 mm/s (corresponding to three fourths (¾) of the normal sheet-conveying speed). The control portion 45 outputs to the feeding control portion 17 the feeding control data D11 such that the sheet-conveying speed of the sheet of paper P is set to three fourths (¾) of the normal sheet-conveying speed.

The feeding control portion 17 decodes the feeding control data D11 to generate the motor control signal S18 such that the sheet-conveying speed of the sheet of paper P is set to three fourths (¾) of the normal sheet-conveying speed. The motor driving portion 18 rotates the pre-registration rollers 13 at the sheet-conveying speed of the sheet of paper P, which corresponds to three fourths (¾) of the normal sheet-conveying speed, based on the motor control signal S18. At a step ST8, the control portion 45 then controls the image forming device 40 to print the image under the normal mode. Thus, the control of the feeders 10, 20 based on the automatic setting of the air-removing conditions corresponding to the coverage rate of the image is finished.

The PP system #1 as an embodiment of the invention is provided with she feeders 10, 20 according to an embodiment of the invention so that if the tray 6 containing the envelopes 50 is selected, when conveying the envelope 50, the posture of the envelope 50 is corrected by hitting the closed portion 51 of the envelope 50, which is opposite side of the opened portion 52 of the envelope 50, against a nip portion between the upper roller 31 and the lower roller 32 and she envelope 50 is then conveyed with the envelope 50 being nipped by the upper roller 31 and she lower roller 32.

Accordingly, it is possible to remove the air from the envelope 50 on the sheet-conveying path 12 reproducibly, which enables the flatness of the envelope 50 to be enhanced before the image is printed under the envelope mode. Since the print is performed on the envelope 50, the flatness of which has been enhanced, it is possible to maintain good print quality of the envelope 50.

Since each of the feeders 10, 20 is provided with the pre-registration rollers 13 each having a roller width (longitudinal length) L which is longer than a width of the envelope 50, each of the surfaces of the rollers contacts the envelope 50 along the overall width length of the envelope 50 so that it is possible to carry out the air-removing operation from the envelope 50 reproducibly.

According to the feeders 10, 20, even if the air enters into the envelope 50 accidentally when the top envelope 50 of the envelopes 50 stacked on the sheet-mounting base 90 of the tray 6 or the like floats using the air suction function and is sucked, the pre-registration rollers 13 can correct the posture of the envelope 50 and can remove the air from the envelope 50 reproducibly by its nipping portion.

Further, according to the feeders 10, 20, the tray 6 or the like containing the envelopes 50 is provided with the height-adjusting member 72 and the special guide plates 73*a*, 73*b* so that when the envelope 50 is sent using the air suction function, it is possible to convey the envelope 50 to the pre-registration rollers 13 so that the height-adjusted top envelope 50 floats and is sucked and the floated and sucked envelope 50 is guided toward a direction of the sheet-conveying path 12.

According to the control method of the feeder 10 or 20, and the PP system #1, it is possible to remove the air from the envelope 50 at the conveying speed of the envelope based on the coverage rate of the image to be formed on the envelope 50 because the control portion 45 controlling the conveying speed of the envelope 50 adjusts the rotation speed of the pre-registration rollers 13 based on the coverage rate of the set envelope mode. This enables the envelope mode to be performed with maintaining better productivity than that of a case where the conveying speed of the envelope 50 is decreased less than the sheet-conveying speed of the sheet of paper P without variation.

According to the control method of the feeder 10 or 20, the coverage rate or the image to be formed on the envelope 50 is compared with a threshold value of the coverage rate as a discriminant criterion thereof and when the coverage rate of the image to be formed on the envelope 50 exceeds the threshold value, the conveying speed of the envelope 50 is set to be slower than a normal conveying speed of the sheet of paper P, so that it is possible to perform the operation of removing the air from the envelope 50 while the envelope 50 is passed through the pre-registration rollers 13 during a longer period of time than the normal passing period of time of the sheet of paper.

According to the control method of the feeder 10 or 20, when the high coverage printing is used on the image to be printed on the envelope 50, the control portion 45 carries out the intermittent rotation control so that it is possible to surely carry out the operation to remove the air from the envelope 50 by stages as compared with the case where the normal sheet of paper is passes through the pre-registration rollers 13.

According to the PP system #1, when the feeders 10, 20 each corresponding to the envelope mode connect the color copy machine 100 in series, it is possible to remove the air from the envelope 50 in every feeder. It is also possible to surely remove the air from the envelope 50, from which the air has been already removed in the feeder 20 of the upstream side, in the feeder 10 of the downstream side when the envelope 50 is conveyed from the feeder 20 of the upstream side to the image forming device 40.

This invention is preferably applied to the PP system in which a large capacity of multiple feeders is connected to a color printer, a black/white printer, a copying machine, a multifunction printer thereof or like.

It should be understood by those skilled in the art that various modifications, combinations, sub-combinations and alterations may occur depending on design, requirements and other factors insofar as they are within the scope of the appended claims or the equivalents thereof.

What is claimed is:

1. A control method of a feeder including:

a feeding portion which stores a sheet of paper containing an envelope with a predetermined size and feeds the stored sheet of paper, the envelope containing an opened portion and a closed portion; and a pair of registration rollers containing an upper roller and a lower roller, each roller having a longitudinal length longer than a width of the fed sheet of paper, the registration rollers correcting a posture of the sheet of paper fed from the feeding portion to convey the sheet of paper toward a downstream side along a sheet-conveying direction, wherein, when conveying the envelope, the posture of the envelope is corrected by hitting the closed portion of the envelope, which is opposite side of the opened portion of the envelope, against a nip portion between the upper and lower rollers of the registration rollers and the envelope is then conveyed with the envelope being nipped by the upper and lower rollers of the registration rollers, the method comprising:

a setting step of setting an envelope mode to control a conveying speed of the envelope based on a coverage rate of an image to be formed on the envelope; and a control step of controlling the conveying speed of the envelope by adjusting a rotation speed of the registration rollers based on the coverage rate of the envelope mode set in the setting step.

2. The control method of a feeder according to claim 1 wherein during the control step, the coverage rate of the image to be formed on the envelope is compared with a threshold value of the coverage rate as a discriminant criterion thereof; and when the coverage rate of the image to be formed on the envelope exceeds the threshold value, the conveying speed of the envelope is set to be slower than a normal conveying speed or when the coverage rate of the image to be formed on the envelope does not exceed the threshold value, the conveying speed of the envelope is set to be the same speed as the normal conveying speed.

3. The control method of a feeder according to claim 2 wherein during the control step, when the coverage rate of the image to be formed on the envelope exceeds the threshold value, an intermittent rotation control to repeat operations to rotate the registration rollers by a predetermined angle and then to stop the rotation thereof is performed.

4. An image forming system comprising:

a feeder including:

a feeding portion which stores a sheet of paper containing an envelope with a predetermined size and feeds the stored sheet of paper, the envelope containing an opened portion and a closed portion; and a pair of registration rollers containing an upper roller and a lower roller, each roller having a longitudinal length longer than a width of the fed sheet of paper, the registration rollers correcting a posture of the sheet of paper fed from the feeding portion to convey the sheet of paper toward a downstream side along a sheet-conveying direction, wherein, when conveying the envelope, the posture of the envelope is corrected by hitting the closed portion of the envelope, which is opposite side of the opened portion of the envelope, against a nip portion between the upper and lower rollers of the registration rollers and the envelope is then conveyed with the envelope being nipped by the upper and lower rollers of the registration rollers;

an image forming device which forms the image on the envelope fed from the feeder, the image forming device connecting the feeder; and a control portion which controls the feeder corresponding to an envelope mode in which the conveying speed of the envelope is controlled based on a coverage rate of the image to be formed on the envelope by the image forming device, wherein the control portion is configured as to receive setting of the envelope mode and to control the conveying speed of the envelope by adjusting a rotation speed of the registration rollers based on the coverage rate of the received envelope mode.

5. The image forming system according to claim 4 wherein the control portion compares the coverage rate of the image to be formed on the envelope with a threshold value of the coverage rate as a discriminant criterion thereof; and when the coverage rate of the image to be formed on the envelope exceeds the threshold value, the control portion sets the conveying speed of the envelope so as to be slower than a normal conveying speed or when the coverage rate of the image to be formed on the envelope does not exceed the threshold value, the control portion sets the conveying speed of the envelope as so to be the same speed as the normal conveying speed.

6. The image forming apparatus according to claim 5 wherein when the coverage rate of the image to be formed on the envelope exceeds the threshold value, the control portion performs an intermittent rotation control to repeat operations to rotate the registration rollers by a predetermined angle and then to stop the rotation thereof.

7. The image forming apparatus according to claim 4 wherein multiple feeders each corresponding to the envelope mode connect the image forming device in series.

* * * * *